US010053909B2

(12) United States Patent
Wang

(10) Patent No.: US 10,053,909 B2
(45) Date of Patent: Aug. 21, 2018

(54) TRIPLE-SHADE ROLLER BLIND

(71) Applicant: J. Paxton Enterprises, Inc., Kaohsiung (TW)

(72) Inventor: Teh-Hao Wang, Kaohsiung (TW)

(73) Assignee: J. Paxton Enterprises, Inc., Kaohsiung (TW)

( * ) Notice: Subject to any disclaimer, the term of this patent is extended or adjusted under 35 U.S.C. 154(b) by 47 days.

(21) Appl. No.: 15/246,918

(22) Filed: Aug. 25, 2016

(65) Prior Publication Data

US 2018/0058142 A1 Mar. 1, 2018

(51) Int. Cl.

| | |
|---|---|
| ***E06B 9/76*** | (2006.01) |
| ***E06B 9/264*** | (2006.01) |
| ***E06B 9/322*** | (2006.01) |
| ***E06B 9/40*** | (2006.01) |
| ***E06B 9/44*** | (2006.01) |
| *E06B 9/24* | (2006.01) |

(52) U.S. Cl.

CPC ..... *E06B 9/264* (2013.01); *E06B 9/322* (2013.01); *E06B 9/40* (2013.01); *E06B 9/44* (2013.01); *E06B 2009/2435* (2013.01); *E06B 2009/2458* (2013.01); *E06B 2009/3222* (2013.01)

(58) Field of Classification Search

CPC . E06B 9/264; E06B 9/40; E06B 9/322; E06B 9/44; E06B 2009/3222; E06B 2009/2458; E06B 2009/2435; E06B 9/307; E06B 9/76

See application file for complete search history.

(56) References Cited

U.S. PATENT DOCUMENTS

| | | | | | |
|---|---|---|---|---|---|
| 1,557,058 | A * | 10/1925 | Johansen | E06B 9/76 | 160/133 |
| 1,833,452 | A * | 11/1931 | Baumbach | E06B 9/174 | 160/309 |
| 4,372,367 | A * | 2/1983 | Baldanello | E06L 39/74 | 160/310 |
| 4,712,599 | A * | 12/1987 | Komaki | E06B 9/165 | 160/133 |
| 6,138,740 | A * | 10/2000 | Chou | E06L 39/36 | 160/298 |
| 6,786,270 | B2 * | 9/2004 | Wen | E06B 9/322 | 160/170 |

(Continued)

FOREIGN PATENT DOCUMENTS

TW M503854 7/2015

*Primary Examiner* — Katherine W Mitchell
*Assistant Examiner* — Abe Massad
(74) *Attorney, Agent, or Firm* — Muncy, Geissler, Olds & Lowe, P.C.

(57) ABSTRACT

A triple-shade roller blind includes a reel shaft for reeling a curtain having front and rear shade layers and a plurality of shading strips interconnecting the front and rear shade layers, and an adjusting assembly having a rotatable coupling member journalled on a pivot pin and coupled with the reel shaft to rotate the same, and an adjusting rod extending downwardly of and rotatable relative to the coupling member. A movement converting mechanism is disposed to convert rotation of the adjusting rod into the rotation of the coupling member as well as the reel shaft so as to adjust the distance between the front and rear shade layers and the shading areas of the shading strips.

4 Claims, 11 Drawing Sheets

(56) References Cited

U.S. PATENT DOCUMENTS

| | | | | |
|---|---|---|---|---|
| 8,851,148 | B2 * | 10/2014 | Lin | E06B 9/40 160/168.1 R |
| 2011/0259533 | A1 * | 10/2011 | Lin | E06B 9/42 160/340 |
| 2014/0216666 | A1 * | 8/2014 | Smith | E06L 39/38 160/84.04 |
| 2014/0262069 | A1 * | 9/2014 | Drew | E06B 9/44 160/120 |
| 2015/0225997 | A1 * | 8/2015 | Soper | E06B 9/42 160/309 |
| 2016/0138334 | A1 * | 5/2016 | Dean | E06B 9/76 160/309 |

* cited by examiner

TRIPLE-SHADE ROLLER BLIND

FIELD

The disclosure relates to a roller blind, and more particularly to a triple-shade roller blind with an adjusting assembly to adjust a shading effect thereof.

BACKGROUND

A current triple-shade roller blind generally includes a curtain having two soft fabric layers reeled on a reel shaft in a headrail for achieving a great variety of light and dark effects, as compared with conventional Venetian style blinds and single cloth blinds. Such roller blind is typically controlled by a manual force or by means of a bead chain to wind up or unwind the curtain. To further adjust the shading effect of the aforesaid roller blind, such as that disclosed in Taiwanese Patent Publication No. M503854, a control mechanism is employed and operated with a bead chain that hangs down to a lower position for facilitating operation. Such bead chain poses choking or strangulation hazards to young children.

SUMMARY

Therefore, an object of the disclosure is to provide a triple-shade roller blind the shading effect of which can be adjusted without the need of a cord or chain.

According to the disclosure, the triple-shade roller blind includes a reel shaft extending along a reel axis in a longitudinal direction, a bearing disposed at an end of the reel shaft to permit rotation of the reel shaft, a curtain and an adjusting assembly. The curtain includes a front shade layer which has a first upper end connected to the reel shaft and which extends in a transverse direction transverse to the longitudinal direction to terminate at a first lower end so as to be wound up on the reel shaft by the rotation of the reel shaft, a rear shade layer which has a second upper end connected to the reel shaft and which extends in the transverse direction to terminate at a second lower end so as to be wound up on the reel shaft by the rotation of the reel shaft, and a plurality of shading strips which are spaced apart from each other in the transverse direction and each of which has front and rear ends that are respectively connected to the front and rear shade layers. The second upper end is angularly displaced from the first upper end about the reel axis to define a distance between the front and rear shade layers. The adjusting assembly is disposed at an opposite end of the reel shaft, and includes a mounting seat, a pivot pin secured on the mounting seat and extending along the reel axis, a coupling member journalled on the pivot pin to be rotated relative to the mounting seat about the reel axis and coupled with the opposite end of the reel shaft to drive the rotation of the reel shaft, an adjusting rod mounted on and rotatable relative to the mounting seat about an adjusting axis, and a movement converting mechanism interconnecting the adjusting rod and the coupling member and converting rotation of the adjusting rod about the adjusting axis into the rotation of the coupling member as well as the rotation of the reel shaft about the reel axis so as to adjust the distance between the front and rear shade layers and thus the shading effect of the roller blind.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
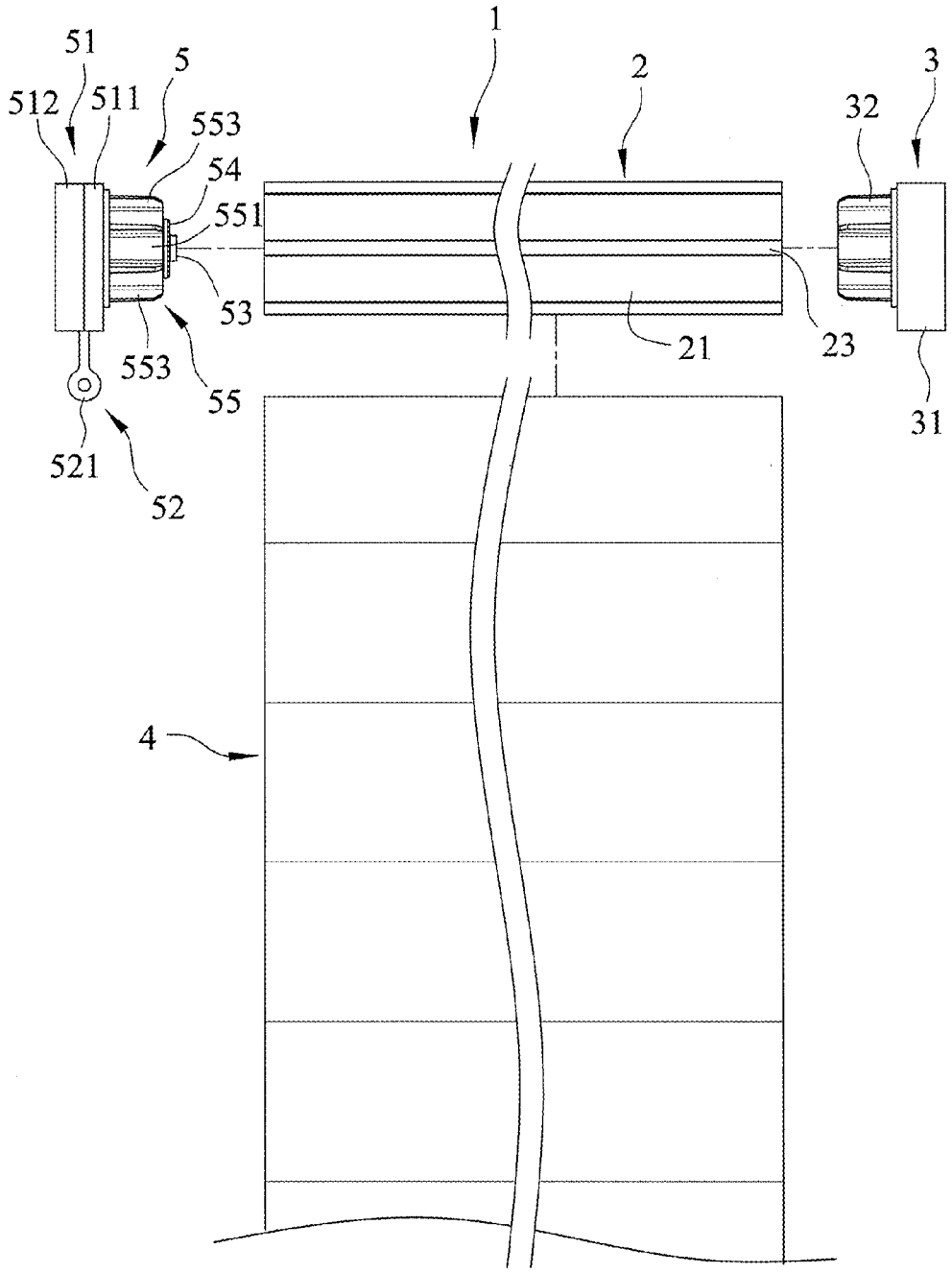
FIG. 1 is a fragmentary exploded front view of an embodiment of a triple-shade roller blind according to the disclosure.

Referring to FIG. 1, an embodiment of a triple-shade roller blind 1 according to this disclosure includes a reel shaft 2, a bearing 3 adapted to be fixed on a window frame (not shown) and disposed at an end of the reel shaft 2 to permit the reel shaft 2 to extend along a reel axis in a longitudinal direction and to be rotatable about the reel axis, a curtain 4 reelably connected to the reel shaft 2, and an adjusting assembly 5 disposed at an opposite end of the reel shaft 2 and adapted to be fixed on the window frame.

Figure 2:
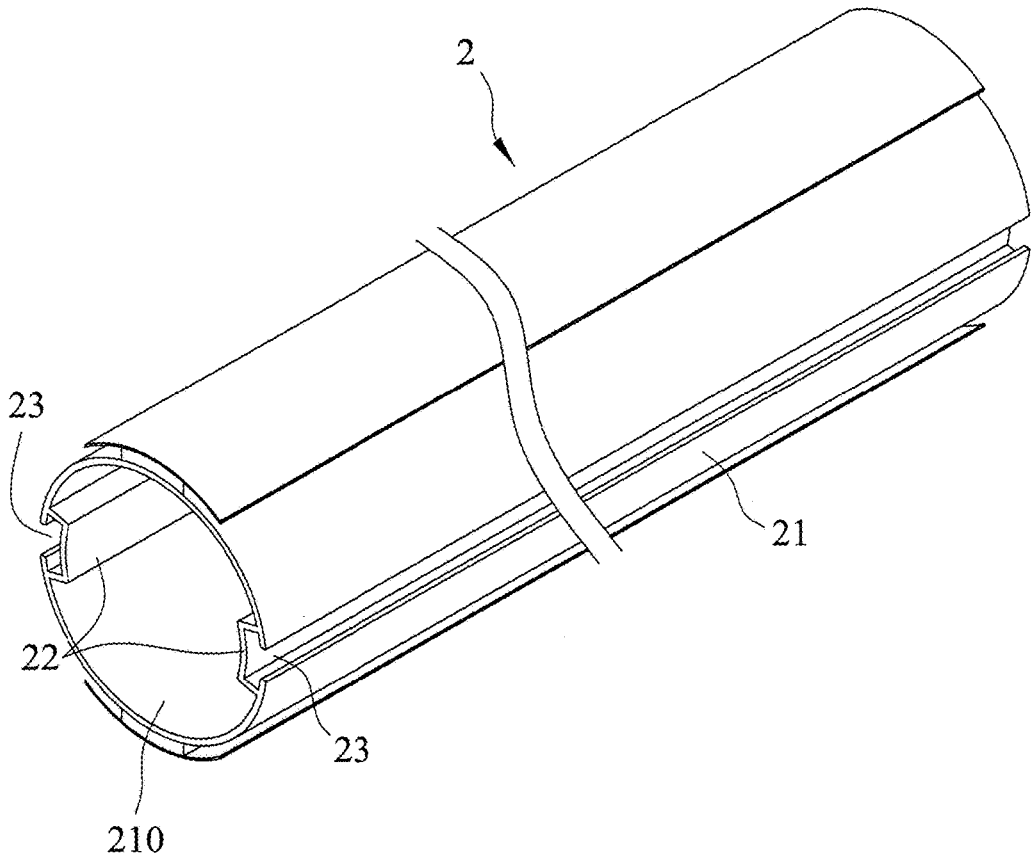
FIG. 2 is a fragmentary perspective view of a reel shaft of the embodiment.

Referring to FIGS. 1 and 2, the reel shaft 2 has a tubular wall 21 surrounding the reel axis and defining a tubular hole 210 therein, and at least one key slot 22 (two key slots 22 in this embodiment) disposed in the tubular wall 21 and within the tubular hole 210. In this embodiment, the reel shaft 2 is made by extruding an aluminum material into a one-single piece. The bearing 3 has a race 31 and a bearing portion 32 that extends from and is rotatable relative to the race 31, and that is securely inserted in the tubular hole 210.

Figure 3:
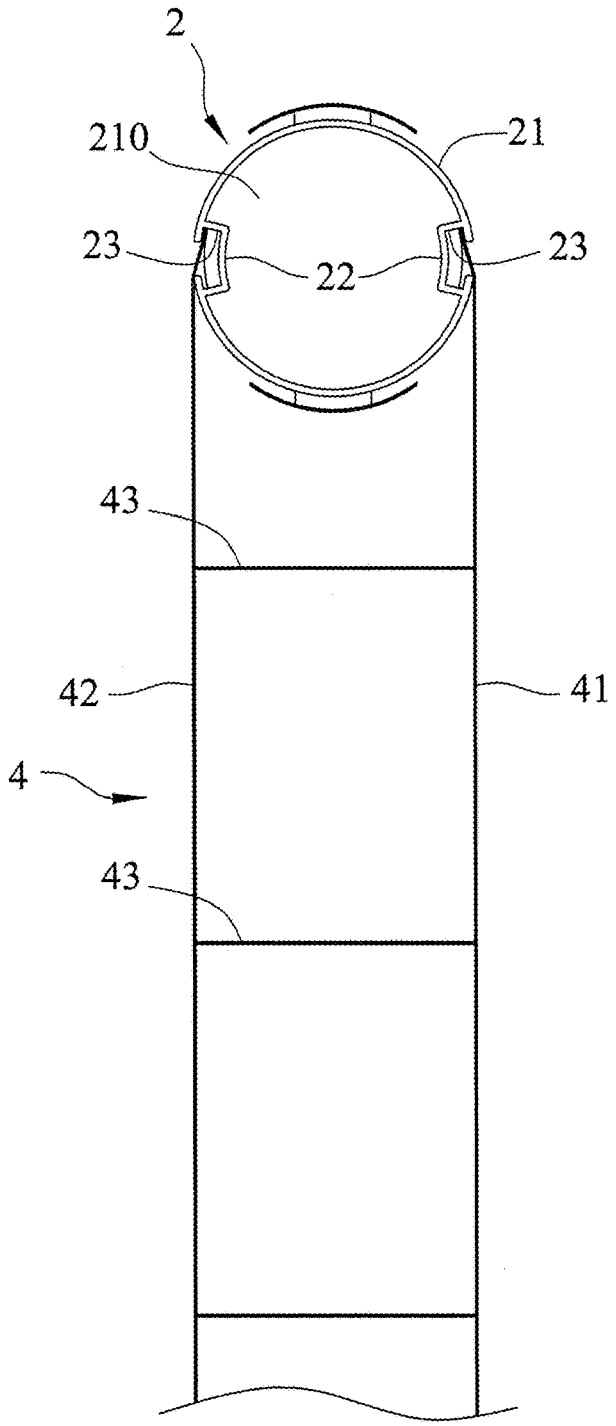
FIG. 3 is a fragmentary, schematic side view of the embodiment.

Referring to FIGS. 1 and 3, the curtain 4 includes a front shade layer 41 having a first upper end, which is connected to the reel shaft 2, and extending in a transverse direction transverse to the longitudinal direction to terminate at a first lower end so as to be wound up on the reel shaft 2 by rotation of the reel shaft 2, a rear shade layer 42 having a second upper end, which is connected to the reel shaft 2, and extending in the transverse direction to terminate at a second lower end so as to be wound up on the reel shaft 2 by the rotation of the reel shaft 2, and a plurality of shading strips 43 spaced apart from each other in the transverse direction and each having front and rear ends that are respectively connected to the front and rear shade layers 41, 42. The second upper end of the rear shade layer 42 is angularly displaced from the first upper end of the front shade layer 41 about the reel axis to define a distance between the front and rear shade layers 41, 42. In this embodiment, the first and second upper ends are diametrically opposite to each other. The front and rear shade layers 41, 42 are made from a translucent or partly translucent material, and the shading strips 43 are made from an opaque and light-shading material.

Figure 4:
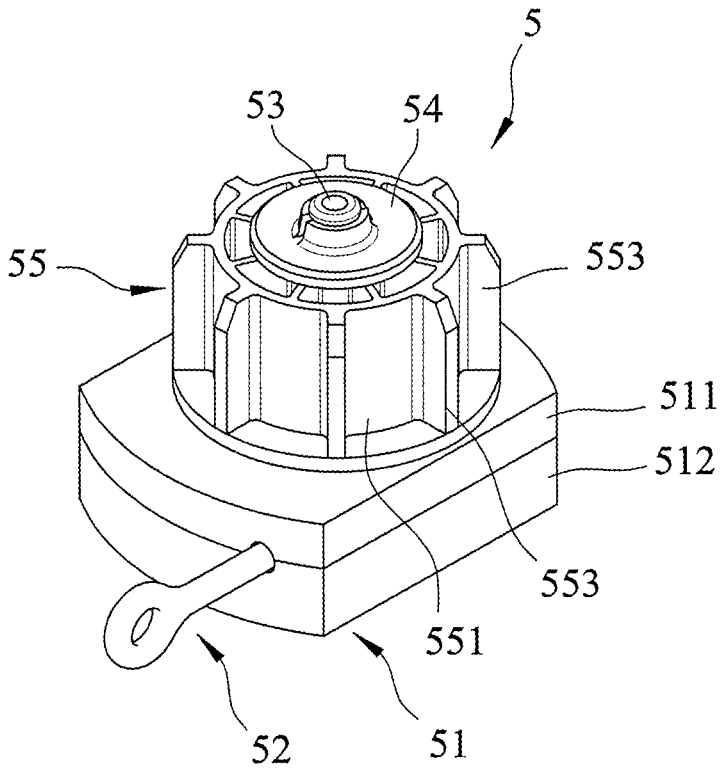
FIG. 4 is a perspective view of an adjusting assembly of the embodiment.

Referring to FIGS. 1 and 4, the adjusting assembly 5 includes a mounting seat 51, a pivot pin 53 secured on the mounting seat 51 and extending along the reel axis, a coupling member 55 journalled on the pivot pin 53 to be rotated relative to the mounting seat 51 about the reel axis and coupled with the opposite end of the reel shaft 2 to drive the rotation of the reel shaft 2, an adjusting rod 52 mounted on the mounting seat 51 and rotatable relative thereto about an adjusting axis in an upright direction that is transverse to both the longitudinal direction and the transverse direction, and a movement converting mechanism interconnecting the adjusting rod 52 and the coupling member 55 and converting rotation of the adjusting rod 52 about the adjusting axis into the rotation of the coupling member 55 as well as the rotation of the reel shaft 2 about the reel axis so as to adjust the distance between the front and rear shade layers 41, 42 (see FIG. 3).

Figure 5:
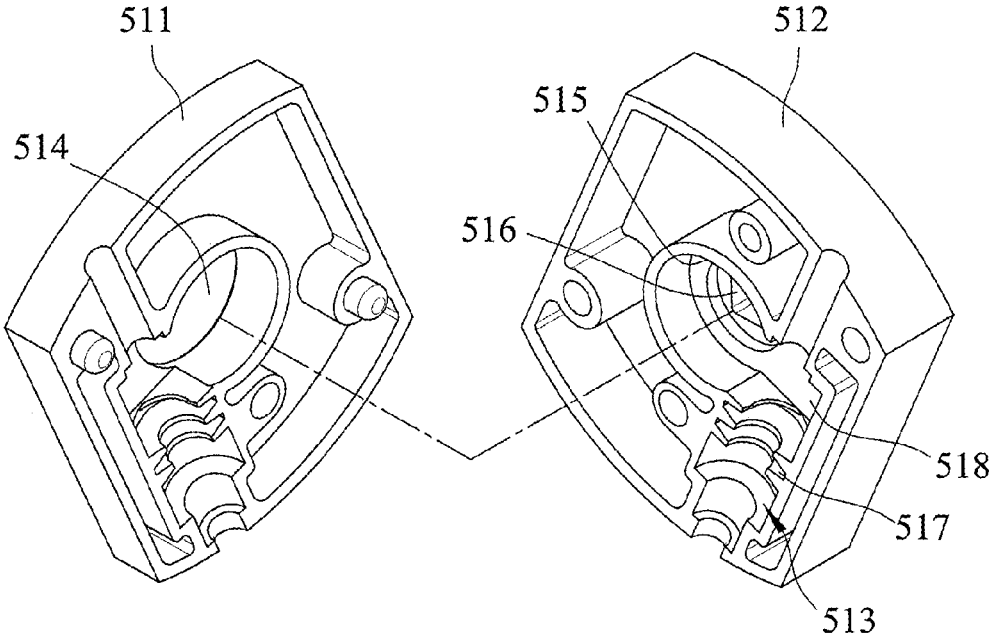
FIG. 5 is an exploded perspective view of a mounting seat of the adjusting assembly.
Figure 6:
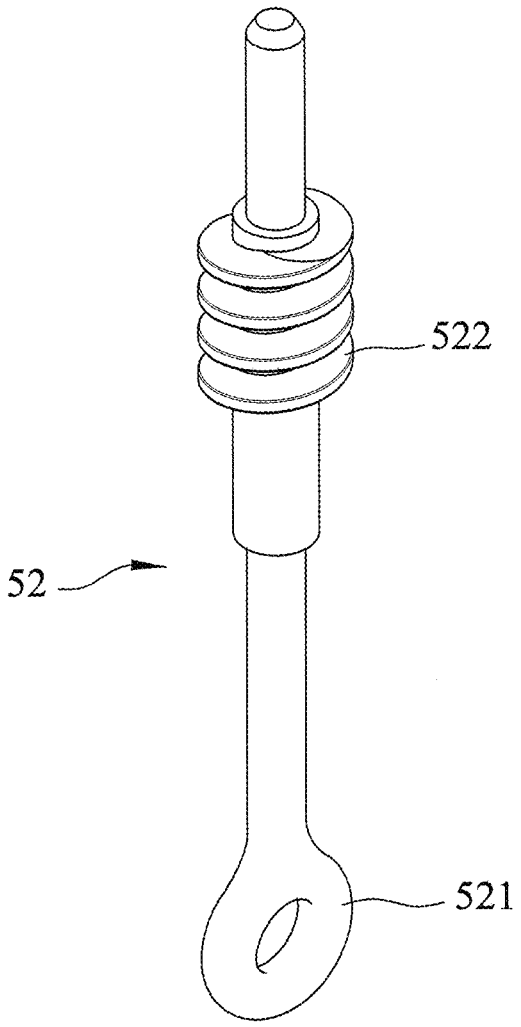
FIG. 6 is a perspective view of an adjusting rod of the adjusting assembly.
Figure 7:
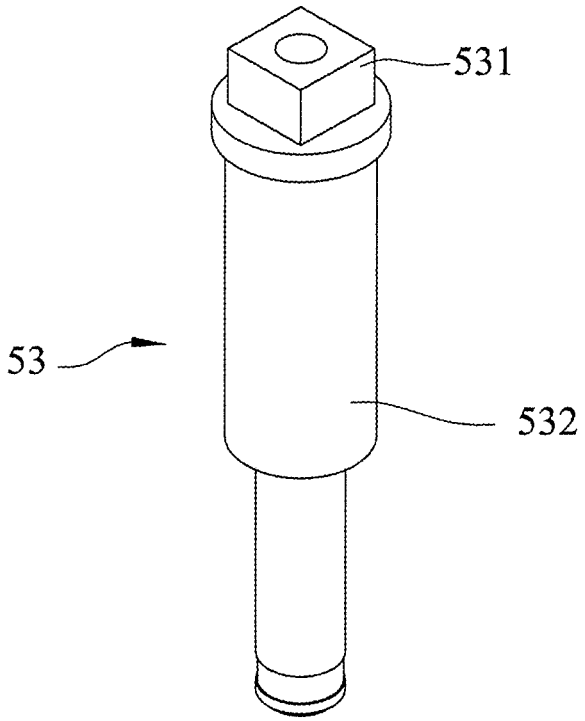
FIG. 7 is a perspective view of a pivot pin of the adjusting assembly.
Figure 8:
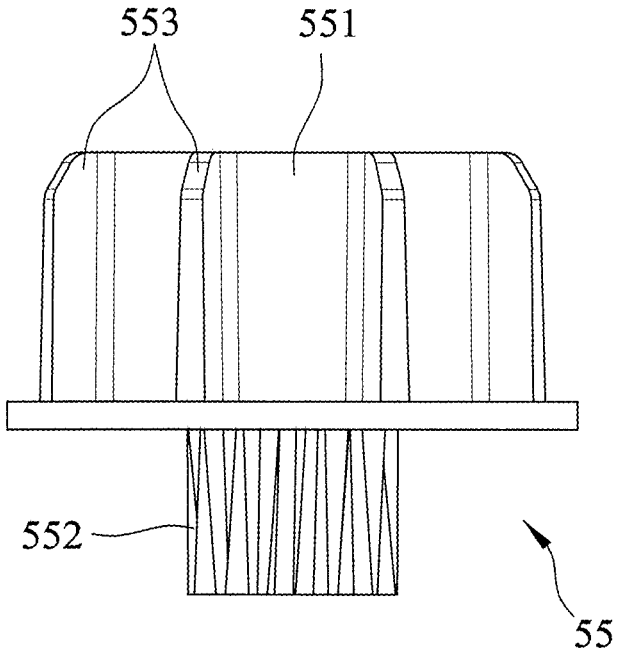
FIG. 8 is a side view of a coupling member of the adjusting assembly.

Specifically, referring to FIGS. 1, 4 and 5, the mounting seat 51 has a first wall 511 having a penetrating bore 514 extending therethrough, and a second wall 512 disposed opposite to the first wall 511 in the longitudinal direction, so that the first and second walls 511, 512 cooperatively define a receiving space 515 and a guiding slot 513 therebetween. The guiding slot 513 has an internally threaded segment 517 and a communicating segment 518 disposed opposite to each other along the adjusting axis. The second wall 512 has a retaining hole 516 extending along the reel axis and in communication with the receiving space 515. The adjusting rod 52 is movably and rotatably disposed in the guiding slot 513 and has an operating portion 521 extending downwardly of the mounting seat 51. With reference to FIG. 7, the pivot pin 53 has a spline portion 531 inserted in and in spline engagement with the retaining hole 516 so as to non-rotatably retain the pivot pin 53 to the mounting seat 51, and an axle portion 532 for the coupling member 55 to be journalled thereon. Each of the spline portion 531 and the retaining hole 516 may have a rectangular cross-section. A washer 54 is sleeved on the pivot pin 53 such that the coupling member 55 is sandwiched between the mounting seat 51 and the washer 54.

Referring to FIGS. 1, 3, 4 and 8, the coupling member 55 has a collar 551 which has a surrounding wall received in the tubular hole 210, and at least one key 553 that is disposed on the surrounding wall and that is engaged with the key slot 22 to permit the rotation of the reel shaft 2 along with the rotation of the coupling member 55.

Referring to FIGS. 5, 6, 8 and 9, in this embodiment, the movement converting mechanism includes a worm wheel portion 552 which is disposed on the coupling member 55 opposite to the collar 551 in the longitudinal direction and which is received in the receiving space 515 through the penetrating bore 514, and a worm portion 522 disposed on the adjusting rod 52 and rotatably received in the guiding slot 513 to mesh with the worm wheel portion 552 so as to convert the rotation of the adjusting rod 52 into the rotation of the coupling member 55.

Figure 9:
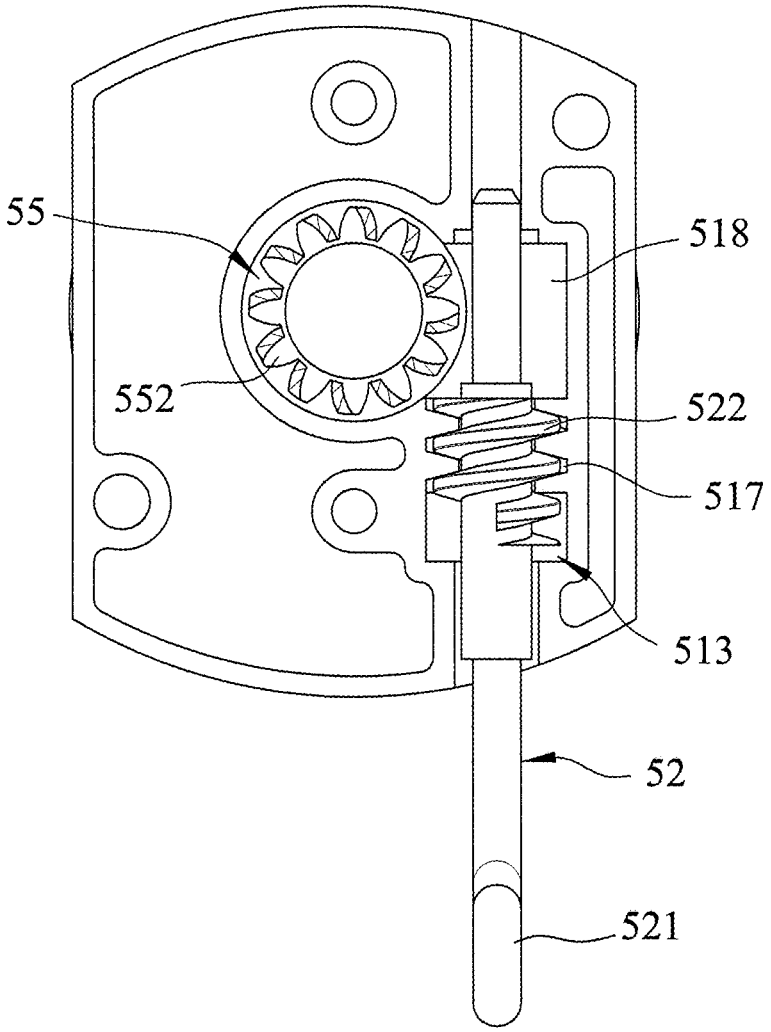
FIG. 9 is a schematic view illustrating a state where the adjusting rod is in a non-adjusting position.
Figure 10:
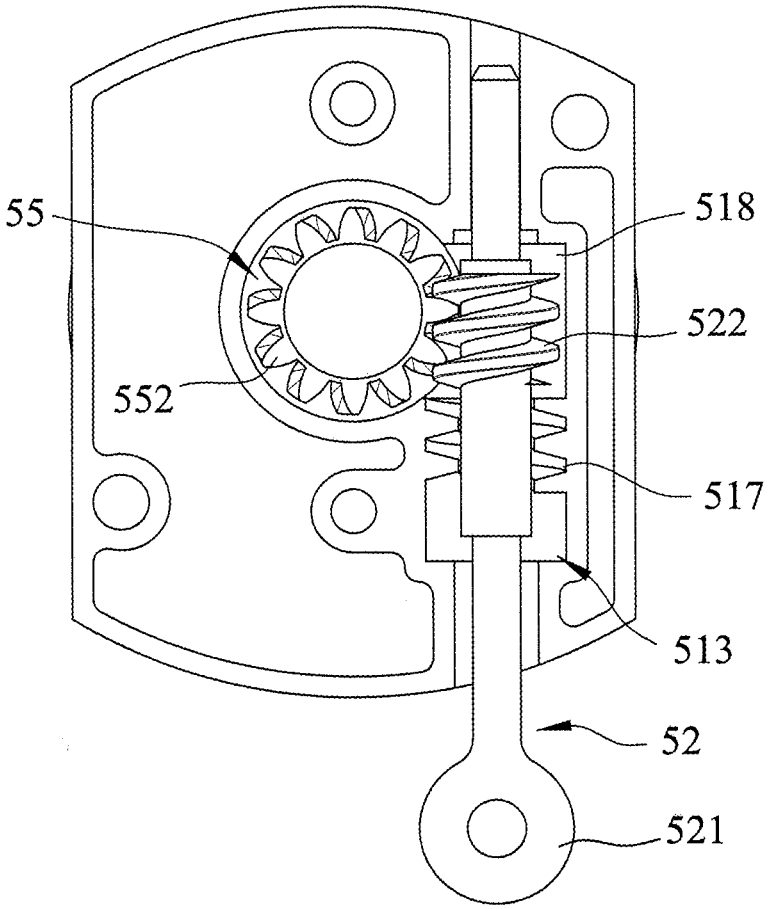
FIG. 10 is a schematic view illustrating a state where the adjusting rod is in an adjusting position.
Figure 11:
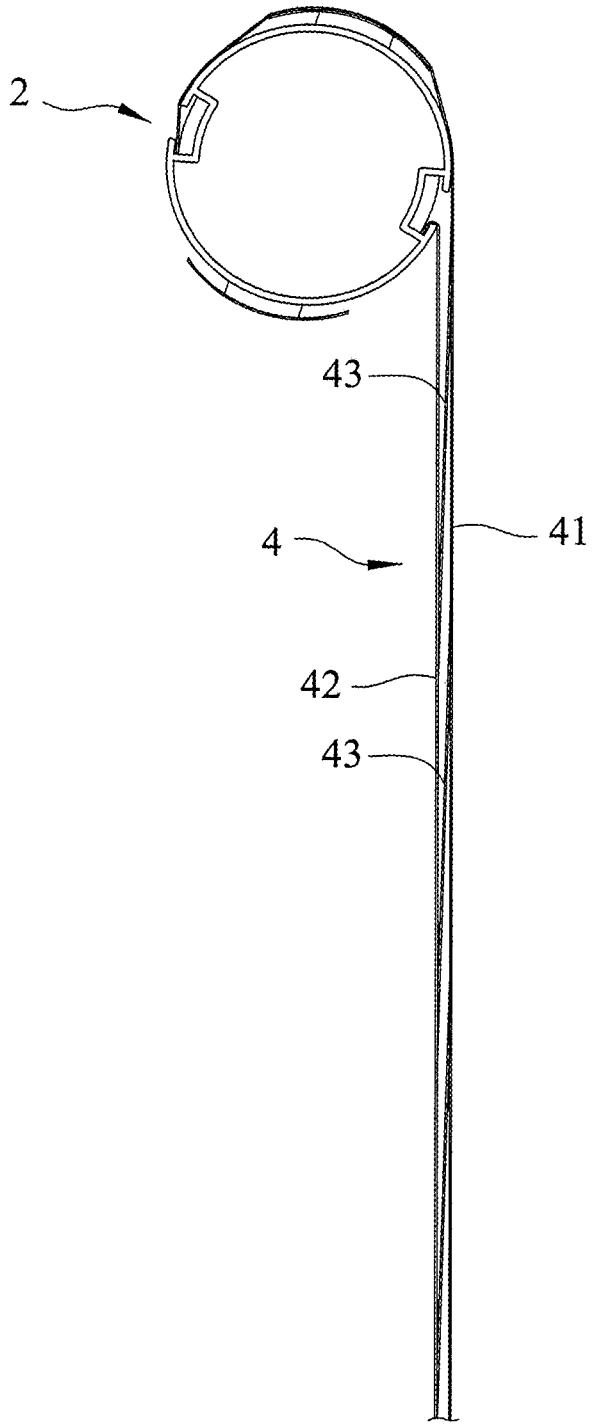
FIG. 11 is a schematic view illustrating a state where a curtain provides a largest shading area.

FIGS. 1 and 9 illustrate the state that the adjusting rod 52 is in a non-adjusting position, where the worm portion 522 is disposed in and engaged with the internally threaded segment 517, and does not mesh with the worm wheel portion 552. When the operating portion 521 of the adjusting rod 52 is rotated about the adjusting axis, the rotation of the adjusting rod 52 is converted into a linear movement of the worm portion 522 to the communicating segment 518 along the adjusting axis by means of a screw-in movement of the worm portion 522 relative to the internally threaded segment 517 so as to place the adjusting rod 52 in an adjusting position (as shown in FIG. 10), where the worm portion 522 meshes with the worm wheel portion 552 in the communicating segment 518. A further rotation of the operating portion 521 of the adjusting rod 52 can result in rotation of the coupling member 55 and the reel shaft 2 about the reel axis. Hence, when the curtain 4 is pulled down to a lowermost position (as shown in FIG. 3), the front and rear shade layers 41, 42 are spaced apart from each other by a largest distance and each shading strip 43 is placed in a horizontal plane to provide a smallest shading area, so that the curtain 4 provides a maximum light transmitting effect. The user can rotate the adjusting rod 52 to the adjusting position, and further rotate the same to adjust the distance between the front and rear shade layers 41, 42 so as to bring the front and rear shade layers 41, 42 close to each other. As shown in FIG. 11, when the distance is the shortest, each shading strip 43 is inclined to provide a largest shading area so that the curtain 4 provides a relatively greater shading effect. To maximize the shading effect, each strip 43 may be brought substantially parallel to the front and rear shade layers 41, 42, and may be adjoined to the adjacent one of the shading strips 43 in the upright direction.

Referring to FIGS. 1, 3 and 11, the user can pull down the curtain 4 for covering a window (not shown). In case that the user cannot reach the curtain 4, the adjusting rod 52 can be rotated to permit lowering of the curtain 4 for facilitating pulling thereof. Furthermore, a long rod (not shown) may be used to be connected to a lower end of the operating portion 521 for manual operation. Besides, a biasing mechanism (not shown) is employed to reel up the curtain 4 in a known manner.

As illustrated, since the curtain 4 can be pulled down by manual operation without the need of a bead chain or a rope, children can be prevented from strangulation or suffocation accidents. The adjusting rod 52 can be rotated to the non-adjusting position so as not to be rotated with the rotation of the reel shaft 2 during reeling out of the curtain 4. Thus, undesired wearing between the worm portion 522 and the worm wheel portion 552 and that between the worm portion 522 and the internally threaded segment 517 are avoided, thereby elongating the service life of the roller blind. The shading effect is adjustable by rotating the adjusting rod 52, which is easily operable and which has a simple and safe construction.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A triple-shade roller blind comprising:

a reel shaft extending along a reel axis in a longitudinal direction;

a bearing disposed at an end of said reel shaft to permit rotation of said reel shaft;

a curtain including a front shade layer which has a first upper end connected to said reel shaft and which extends in a transverse direction transverse to the longitudinal direction to terminate at a first lower end so as to be wound up on said reel shaft by the rotation of said reel shaft, a rear shade layer which has a second upper end connected to said reel shaft and which extends in the transverse direction to terminate at a second lower end so as to be wound up on said reel shaft by the rotation of said reel shaft, and a plurality of shading strips which are spaced apart from each other in the transverse direction and each of which has front and rear ends that are respectively connected to said front and rear shade layers, said second upper end being angularly displaced from said first upper end about the reel axis to define a distance between said front and rear shade layers; and an adjusting assembly disposed at an opposite end of said reel shaft, and including a mounting seat, a pivot pin which is secured on said mounting seat and which extends along the reel axis, a coupling member which is journalled on said pivot pin to be rotated relative to said mounting seat about the reel axis and which is coupled with said opposite end of said reel shaft to drive the rotation of said reel shaft, an adjusting rod which is mounted on and rotatable relative to said mounting seat about an adjusting axis, and a movement converting mechanism which interconnects said adjusting rod and said coupling member and which converts rotation of said adjusting rod about the adjusting axis into the rotation of said coupling member as well as the rotation of said reel shaft about the reel axis so as to adjust the distance between said front and rear shade layers, wherein, said mounting seat has a first wall having a penetrating bore extending therethrough, and a second wall disposed opposite to said first wall in the longitudinal direction, so that the first and second walls cooperatively define a receiving space and a guiding slot therebetween, said movement converting mechanism including a worm wheel portion disposed on said coupling member and received in said receiving space through said penetrating bore, and a worm portion disposed on said adjusting rod and rotatably received in said guiding slot to mesh with said worm wheel portion so as to convert the rotation of said adjusting rod into the rotation of said coupling member, and wherein, said guiding slot has an internally threaded segment and a communicating segment disposed opposite to each other along the adjusting axis, and configured such that the rotation of said adjusting rod is converted into a linear movement of said worm portion to said communicating segment along the adjusting axis by means of a screw-in movement of said worm portion relative to said internally threaded segment, and such that said worm portion meshes with said worm wheel portion in said communicating segment, wherein the internally threaded segment and the communicating segment are integrally formed in the first and second walls of the mounting seat.

2. The triple-shade roller blind as claimed in claim 1, wherein said reel shaft has a tubular wall surrounding the reel axis and defining a tubular hole therein, and at least one key slot disposed in said tubular wall and within said tubular hole, said coupling member having a collar which is disposed opposite to said worm wheel portion in the longitudinal direction and which has a surrounding wall received in said tubular hole, and at least one key that is disposed on said surrounding wall and that is engaged with said key slot to permit the rotation of said reel shaft along with the rotation of said coupling member.

3. The triple-shade roller blind as claimed in claim 1, wherein said second wall has a retaining hole extending along the reel axis and in communication with said receiving space, said pivot pin having a spline portion inserted in and in spline engagement with said retaining hole so as to non-rotatably retain said pivot pin to said mounting seat.

4. The triple-shade roller blind as claimed in claim 1, wherein said adjusting assembly further includes a washer sleeved on said pivot pin such that said coupling member is sandwiched between said mounting seat and said washer.

* * * * *